United States Patent [19]

Petzold et al.

[11] 4,139,553

[45] Feb. 13, 1979

[54] HYDROXYSULFOBETAINES AND THEIR USE IN ANTISTATIC FINISHING OF SYNTHETIC FIBER MATERIALS

[75] Inventors: Manfred Petzold, Düsseldorf-Holthausen; Karl Mahall, Monheim-Baumberg; Irmhild Goebel, Düsseldorf, all of Fed. Rep. of Germany

[73] Assignee: Henkel Kommanditgesellschaft auf Aktien, Düsseldorf-Holthausen, Fed. Rep. of Germany

[21] Appl. No.: 815,727

[22] Filed: Jul. 14, 1977

[30] Foreign Application Priority Data

Jul. 22, 1976 [DE] Fed. Rep. of Germany ..... 2632988

[51] Int. Cl.$^2$ ..... C07C 143/14; C09K 3/16

[52] U.S. Cl. ..... 260/501.12; 260/459 A; 427/390 B

[58] Field of Search ..... 260/501.12, 459 A

[56] References Cited

U.S. PATENT DOCUMENTS

| | | | |
|---|---|---|---|
| 2,781,389 | 2/1957 | Mannheimer | 260/501.12 |
| 3,198,822 | 8/1965 | Mannheimer et al. | 260/501.12 |
| 3,227,749 | 1/1966 | Camlore et al. | 260/501.12 |
| 3,547,985 | 12/1970 | Rinkler et al. | 260/501.12 |
| 3,894,077 | 7/1975 | Horikawa et al. | 260/501.12 |

*Primary Examiner*—James O. Thomas, Jr.
*Assistant Examiner*—G. T. Breitenstein
*Attorney, Agent, or Firm*—Hammond & Littell

[57] ABSTRACT

Hydroxysulfobetaines having the formula

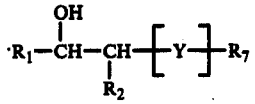

wherein Y represents two to five substituted nitrogens connected by $-(CH_2)_m-$ groups, selected from the group consisting of

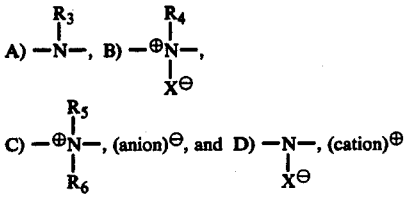

with the proviso that at least one of Y is B); $R_1$ is an alkyl and $R_2$ is a member selected from the group consisting of hydrogen and alkyl, where the sum of the carbon atoms in $R_1 + R_2$ is from 9 to 22; $R_3$ is a member selected from the group consisting of hydrogen, hydroxyethyl and alkyl having from 1 to 5 carbon atoms; $R_4$, $R_5$ and $R_6$ are individually members selected from the group consisting of hydroxyethyl and alkyl having from 1 to 5 carbon atoms; $R_7$ is a member selected from the group consisting of

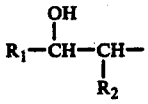

and $R_4$; $X^\ominus$ is a member selected from the group consisting of $-(CH_2)_n-SO_3^\ominus$ and $-CH_2-CH(OH)-CH_2-SO_3^\ominus$; m is an integer from 2 to 6; n is an integer from 1 to 4; $(anion)^\ominus$ represents an anionic group; and $(cation)^\oplus$ represents a cationic group, as well as the method of making fiber materials antistatic by applying an above hydroxysulfobetaine as well as hydroxycarbobetaines thereto.

5 Claims, No Drawings

HYDROXYSULFOBETAINES AND THEIR USE IN ANTISTATIC FINISHING OF SYNTHETIC FIBER MATERIALS

BACKGROUND OF THE INVENTION

Quaternary ammonium salts are frequently used for the antistatic finishing of synthetic fiber materials. However, these compounds frequently do not have adequate substantivity relative to synthetic fiber materials, particularly relative to polyamide fiber materials, so that finishing from an aqueous liquor by the bath exhaust process leads to unsatisfactory use of the bath. Furthermore, the antistatic effect is not always adequate.

Published Japanese Patent Application No. 26 523/67 describes sulfonate betaines, containing an alkyl radical having 12 to 16 carbon atoms, as antistatic agents for incorporation in plastics material. However, the antistatic effect of these compounds is not particularly high. Furthermore, German Auslegeschrift application (DOS) 24 09 412 also describes sulfonate betaines having a hydroxyalkyl derived from α-olefins and having 8 to 18 carbon atoms. These compounds have a relatively low water-solubility and are only recommended as antistatic agents for incorporation in plastic materials.

OBJECTS OF THE INVENTION

An object of the present invention is the development of novel hydroxybetaines which are useful for the antistatic finishing of synthetic fiber materials.

Another object of the present invention is the development of hydroxysulfobetaines having the formula

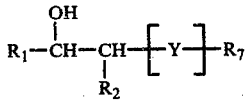

wherein Y represents two to five substituted nitrogens connected by $-(CH_2)_m-$ groups, selected from the group consisting of

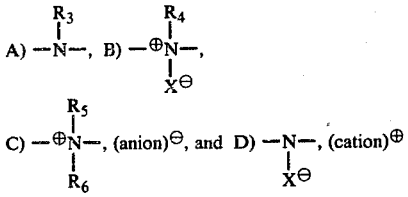

with the proviso that at least one of Y is B); $R_1$ is an alkyl and $R_2$ is a member selected from the group consisting of hydrogen and alkyl, where the sum of the carbon atoms in $R_1 + R_2$ is from 9 to 22; $R_3$ is a member selected from the group consisting of hydrogen, hydroxyethyl and alkyl having from 1 to 5 carbon atoms; $R_4$, $R_5$ and $R_6$ are individually members selected from the group consisting of hydroxyethyl and alkyl having from 1 to 5 carbon atoms; $R_7$ is a member selected from the group consisting of

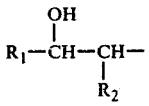

and $R_4$; $X^{\ominus}$ is a member selected from the group cohsisting of $-(CH_2)_n-SO_3^{\ominus}$ and $-CH_2-CH(OH)-CH_2-SO_3^{\ominus}$; m is an integer from 2 to 6; n is an integer from 1 to 4; $(anion)^{\ominus}$ represents an anionic group; and $(cation)^{\oplus}$ represents a cationic group.

A further object of the present invention is the development of a process for the antistatic finishing of synthetic fiber materials consisting essentially of immersing synthetic fiber materials in an aqueous solution consisting essentially of water and mixtures of water and lower alkanols, said solution containing from 0.1 to 3 gm/l of at least one hydroxybetaine having the formula

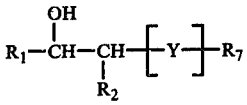

wherein Y represents two to five substituted nitrogens connected by $-(CH_2)_m-$ groups, selected from the group consisting of

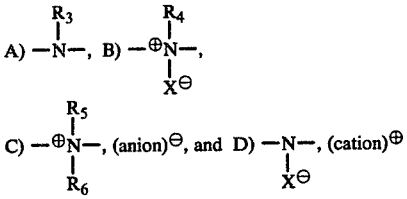

with the proviso that at least one of Y is B); $R_1$ is an alkyl and $R_2$ is a member selected from the group consisting of hydrogen and alkyl, where the sum of the carbon atoms in $R_1 + R_2$ is from 9 to 22; $R_3$ is a member selected from the group consisting of hydrogen, hydroxyethyl and alkyl having from 1 to 5 carbon atoms; $R_4$, $R_5$ and $R_6$ are individually members selected from the group consisting of hydroxyethyl and alkyl having from 1 to 5 carbon atoms; $R_7$ is a member selected from the group consisting of

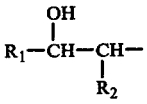

and $R_4$; $X^{\ominus}$ is a member selected from the group consisting of $-(CH_2)_n-COO^{\ominus}$, $-(CH_2)_n-SO_3^{\ominus}$ and $-CH_2-CH(OH)-CH_2-SO_3^{\ominus}$; m is an integer from 2 to 6; n is an integer from 1 to 4; $(anion)^{\ominus}$ represents an anionic group; and $(cation)^{\oplus}$ represents a cationic group, for a time sufficient to effect an antistatic finish and recovering said synthetic fiber materials having an antistatic finish.

These and other objects of the present invention will become more apparent as the description thereof proceeds.

DESCRIPTION OF THE INVENTION

The present invention provides novel hydroxysulfobetaines of the general formula

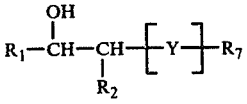

wherein Y comprises 2 to 5 groups, combined by $-(CH_2)_m-$, of the formula

A) $-\overset{R_3}{\overset{|}{N}}-$, or

B) $-\left[\overset{R_4}{\overset{|}{N}}{}^{\oplus}\underset{X^{\ominus}}{|}\right]-$, or C) $-\left[\overset{R_5}{\underset{R_6}{\overset{|}{N}}}{}^{\oplus}\right]-\cdot[\text{anion}]^{\ominus}$, or D) $-\left[\underset{X^{\ominus}}{\overset{|}{N}}\right]-\cdot[\text{cation}]^{\oplus}$ at least one of which is B, while $R_1$ = alkyl radical $R_2$ = H or alkyl radical $\Sigma(R^1 + R^2)$ = 9 to 22 carbon atoms $R_3$ = H or alkyl radical having 1 to 5 carbon atoms or hydroxyethyl radical $R_4$, $R_5$, $R_6$ = alkyl radical having 1 to 5 carbon atoms or hydroxyethyl radical $$R_7 = R_1-CH(OH)\underset{R_2}{\underset{|}{CH}}- \text{ or } R_4$$

$X = X_2 = -(CH_2)_n-SO_3{}^{\ominus}$ or $X_3 = -CH_2-CH(OH)-CH_2SO_3{}^{\ominus}$ m = 2 to 6 n = 1 to 4

$[\text{Anion}]^{\ominus}$ can be a monovalent anionic group, preferably $Cl^{\ominus}$, $Br^{\ominus}$, $I^{\ominus}$, $CH_3OSO_3{}^{\ominus}$, $C_2H_5OSO_3{}^{\ominus}$.

$[\text{Cation}]^{\oplus}$ can be a monovalent cationic group, preferably $H^{\oplus}$, $Na^{\oplus}$, $K^{\oplus}$, $NH_4{}^{\oplus}$, amine $^{\oplus}$.

A further object of the invention is the use of these hydroxysulfobetaines, as well as hydroxycarboxybetaines, in aqueous or aqueous-alcoholic solutions for the antistatic finishing of synthetic fiber materials.

More particularly, the present invention is directed to hydroxysulfobetaines having the formula $$R_1-\overset{OH}{\overset{|}{CH}}-\underset{R_2}{\underset{|}{CH}}-\left[Y\right]-R_7$$

wherein Y represents two to five substituted nitrogens connected by $-(CH_2)_m-$ groups, selected from the group consisting of A) $-\overset{R_3}{\overset{|}{N}}-$, B) $-\overset{R_4}{\underset{X^{\ominus}}{\overset{|}{N}}}{}^{\oplus}-$, C) $-\overset{R_5}{\underset{R_6}{\overset{|}{N}}}{}^{\oplus}-$, $(\text{anion})^{\ominus}$, and D) $-\underset{X^{\ominus}}{\overset{|}{N}}-$, $(\text{cation})^{\oplus}$ with the proviso that at least one of Y is B); $R_1$ is an alkyl and $R_2$ is a member selected from the group consisting of hydrogen and alkyl, where the sum of the carbon atoms in $R_1 + R_2$ is from 9 to 22; $R_3$ is a member selected from the group consisting of hydrogen, hydroxyethyl and alkyl having from 1 to 5 carbon atoms; $R_4$, $R_5$ and $R_6$ are individually members selected from the group consisting of hydroxyethyl and alkyl having from 1 to 5 carbon atoms; $R_7$ is a member selected from the group consisting of $$R_1-\overset{OH}{\overset{|}{CH}}-\underset{R_2}{\underset{|}{CH}}-$$

and $R_4$; $X^{\ominus}$ is a member selected from the group consisting of $-(CH_2)_n-SO_3{}^{\ominus}$ and $-CH_2-CH(OH)-CH_2-SO_3{}^{\ominus}$; m is an integer from 2 to 6; n is an integer from 1 to 4; $(\text{anion})^{\oplus}$ represents an anionic group; and $(\text{cation})^{\ominus}$ represents a cationic group.

The $(\text{anion})^{\ominus}$ is preferably selected from the group consisting of a halogen anion, a lower alkyl sulfato anion and a lower alkyl sulfono anion. The $(\text{cation})^{\oplus}$ is preferably selected from the group consisting of hydrogen, alkali metal, ammonium, lower alkyl amine and lower alkylol amine.

In addition, the present invention relates to a process for the antistatic finishing of synthetic fiber materials consisting essentially of immersing synthetic fiber materials in an aqueous solution consisting essentially of water and mixtures of water and lower alkanols, siad solution containing from 0.1 to 3 gm/l of at least one hydroxybetaine having the formula $$R_1-\overset{OH}{\overset{|}{CH}}-\underset{R_2}{\underset{|}{CH}}-\left[Y\right]-R_7$$

wherein Y represents two to five substituted nitrogens connected by $-(CH_2)_m-$ groups, selected from the group consisting of A) $-\overset{R_3}{\overset{|}{N}}-$, B) $-\overset{R_4}{\underset{X^{\ominus}}{\overset{|}{N}}}{}^{\oplus}-$, C) $-\overset{R_5}{\underset{R_6}{\overset{|}{N}}}{}^{\oplus}-$, $(\text{anion})^{\ominus}$, and D) $-\underset{X^{\ominus}}{\overset{|}{N}}-$, $(\text{cation})^{\oplus}$ with the proviso that at least one of Y is B); $R_1$ is an alkyl and $R_2$ is a member selected from the group consisting of hydrogen and alkyl, where the sum of the carbon atoms in $R_1 + R_2$ is from 9 to 22; $R_3$ is a member selected from the group consisting of hydrogen, hydroxyethyl and alkyl having from 1 to 5 carbon atoms; $R_4$, $R_5$ and $R_6$ are individually members selected from the group consisting of hydroxyethyl and alkyl having from 1 to 5 carbon atoms; $R_7$ is a member selected from the group consisting of $$R_1-\overset{OH}{\overset{|}{CH}}-\underset{R_2}{\underset{|}{CH}}-$$

and $R_4$; $X^{\ominus}$ is a member selected from the group consisting of $-(CH_2)_n-COO^{\ominus}$, $-(CH_2)_n-SO_3{}^{\ominus}$ and $-CH_2-CH(OH)-CH_2-SO_3^{\ominus}$; m is an integer from 2 to 6; n is an integer from 1 to 4; (anion)$^{\ominus}$ represents an anionic group; and (cation)$^{\oplus}$ represents a cationic group, for a time sufficient to effect an antistatic finish and recovering said synthetic fiber materials having an antistatic finish.

The hydroxysulfobetaines are produced by reacting α-olefins (α-alkenes) or non-terminal olefins (alkenes) containing 11 to 24 carbon atoms and whose olefinic double bond can be statistically distributed along the hydrocarbon chain, with epoxydizing agents, such as peracetic acid, to form the corresponding olefin epoxides, reacting the latter with di- or polyamines which have at least one aminohydrogen atom in the molecule, such as N,N-dimethylaminopropylamine, bis-(3-aminopropyl)-methylamine, N'-dimethylaminoethyl-N,N'-dimethylethylene-diamine, or N'-ethanol-N'-methylethylene diamine, to form an aminoalkanol of Formula II:

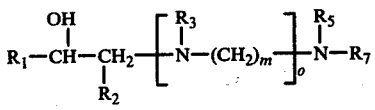

(II)

wherein $R_1$, $R_2$, $R_3$, $R_5$ and $R_7$ have the above assigned values and o is an integer from 1 to 4. These starting amino alkanols of Formula II above can be produced analogously to the processes disclosed in German published application DOS No. 25 20 267.9 and U.S. patent application Ser. No. 683,322, filed May 5, 1976, the teachings of which U.S. patent application are incorporated herein by reference, by reacting one or more epoxyalkanes of the formula:

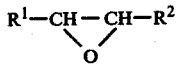

(IV)

with one or more amines of the formula

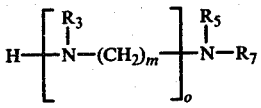

(V)

wherein $R_1$, $R_2$, $R_3$, $R_5$ and $R_7$, m and o have the above assigned values.

Epoxyalkanes of the Formula IV above having non-terminal or terminal epoxy groups, 11 to 24 carbon atoms and preferably an unbranched alkyl chain, are suitable as starting materials. Mixtures of epoxyalkanes are also useful, such as those having different chain lengths and/or the epoxy group in isomeric positions. The epoxyalkanes of Formula IV are obtainable in a known manner by epoxidation of corresponding olefins or olefin mixtures. The above-mentioned mixtures of epoxyalkanes have been found to be especially suitable in the production of the betaines of the present invention. Such mixtures of epoxyalkanes having at least 11 carbon atoms in their chain lengths give satisfactory results.

Where the aminoalkanols of Formula II have a hydrogen for $R_3$ and it is desired to alkylate the same, this can be performed by conventional methods to form a peralkylated compound where all nitrogens are tertiary amines. However, the amine of Formula V can also be a secondary amine where $R_3$ is alkyl or hydroxyethyl.

The aminoalkanols of Formula II are readily converted to the hydroxysulfobetaines by reaction with the desired amount of a 1,ω-alkanesultone having 1 to 4 carbons in the alkane, such as 1,3-propanesultone, or 3-chloro-2-hydroxypropane-1-sulfonic acid, or a salt thereof, dissolved in water under customary quaternizing conditions. The amount of quaternizing agent employed depends on the amount of nitrogen groups B or D desired in the hydroxysulfobetaines.

Subsequent to the production of the hydroxysulfobetaines, the tertiary nitrogen atoms which were not quaternized with the alkyl sulfonic groups may optionally be quaternized with quaternizing agents such as alkyl halides and dialkyl sulfates as well as the corresponding ethylol compounds where the alkyl has from 1 to 5 carbon atoms, such as methyl chloride or dimethylsulfate.

The hydroxycarboxybetaines which are also employed in the process of antistatic finishing are produced comparably. Many of these hydroxycarboxybetaines are disclosed in U.S. patent applications Ser. No. 758,035, filed Jan. 10, 1977, now U.S. Pat. No. 4,076,743, and Ser. No. 784,738, filed Apr. 5, 1977, and these applications are incorporated herein by reference.

Examples of the compounds claimed in accordance with the invention are:

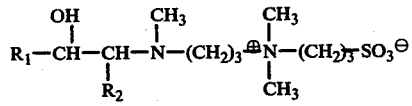

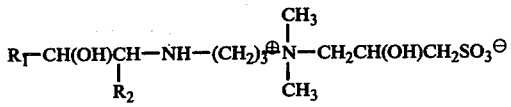

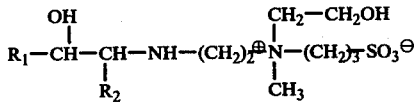

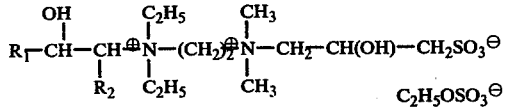

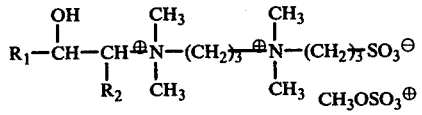

In addition, the following hydroxycarboxybetaines may be employed in the process of the invention:

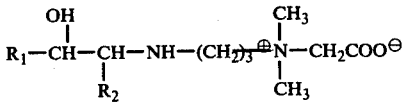

-continued

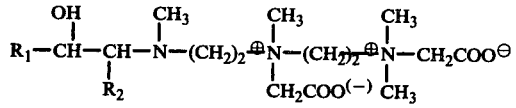

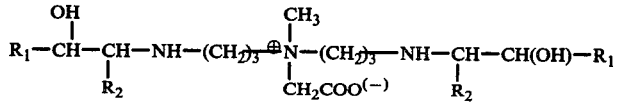

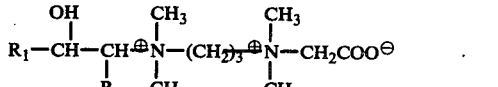

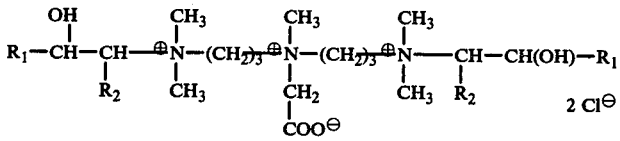

wherein $R_1$ and $R_2$ have the meanings already given. By way of example, $R_1$ is an alkyl radical having 47% $C_{14}$, 44.6% $C_{15}$, 8.4% $C_{16}$ and higher, and $R_2$ = H, or $\Sigma(R_1 + R_2)$ = 25% $C_{13}$, 30% $C_{14}$, 30% $C_{15}$, and 15% $C_{16}$.

All of the above hydroxycarboxybetaines themselves are novel except for those of the first formula, that is, those compounds where $R_3$ is hydrogen.

The betaines have an unexpectedly high degree of antistatic efficacy and have an excellent substantivity for synthetic fiber material. They are used in the form of aqueous or aqueous-alcoholic solutions having a content of from 0.1 to 3 gm/l, preferably 0.5 to 2 gm/l of betaine. Suitable alcohols are, preferably, the water-miscible alkanols such as ethanol, propanol or isopropanol. Owing to the high substantivity, it is particularly advantageous to use the bath exhaust method, thus utilizing the liquor to good advantage. The quantity applied to the fiber materials should be 0.2% to 2%, preferably 0.5% to 1%, relative to the weight of the fiber materials.

The hydroxybetaines are suitable for the antistatic finishing of all synthetic fiber materials such as polyamide, polyester, polyacrylonitrile, polyethylene, polypropylene or polyvinylchloride fiber materials. The materials can be present in the form of fibers, threads, textile fabrics, knitted fabrics etc. The treatment reliably suppresses the occurrence of electrostatic charges during the processing or the use of the fiber materials.

The following examples are illustrative of the practice of the invention without being limitative in any respect.

EXAMPLE 1-6

Preparation of Hydroxycarboxybetaines 112 gm (1.1 mols) of N,N-dimethyl-1,3-propylenediamine were added dropwise to 198 gm (approximately 1 mol) of a $C_{11-14}$ epoxide mixture (with the following chain length distribution of non-terminal epoxides: approximately 22% by weight of $C_{11}$, approximately 30% by weight of $C_{12}$, approximately 26% by weight of $C_{13}$ and approximately 22% by weight of $C_{14}$), 18 gm (0.2 mol) of glycerine and a few drops of N,N-dimethyl-1,3-propylenediamine. The mixture was subsequently stirred for a further 2 hours under reflux (200° to 210° C.), and the glycerine was washed out with water. 258 gm (90% of theory) of the aminoalkanol obtained were purified by distillation and added to an aqueous solution of 104 gm of the sodium salt of chloroacetic acid and the mixture was stirred at 80° to 90° C. for a half hour until a homogeneous phase had formed. The betaine has the physical data given in the following Table 1.

Further hydroxycarboxybetaines were produced analogously to the above process. The physical data of these additional betaines are presented in the following Table 1.

TABLE 1

| Product | $R_1$ | $R_2$ | $R_3$ | $R_4$ | $R_7$ | m | n | No. of Groups A | No. of Groups B | Active Content % | NaCl Content % | pH Value (1% solution) |
|---|---|---|---|---|---|---|---|---|---|---|---|---|
| 1 | Σ (9-12) | | H | $CH_3$ | $CH_3$ | 3 | 1 | 1 | 1 | 35.7 | 5.54 | 9.05 |
| 2 | 10-12 | H | H | $CH_3$ | $CH_3$ | 3 | 1 | 1 | 1 | — | — | — |
| 3 | 12-14 | H | $CH_3$ | $CH_3$ | $CH_3$ | 2 | 1 | 1 | 2 | — | — | — |
| 4 | Σ (13-16) | | H | $CH_3$ | $CH_3$ | 3 | 1 | 1 | 1 | — | — | — |
| 5 | 14-16 | H | H | $CH_3$ | $CH_3$ | 3 | 1 | 1 | 1 | 36.2 | 4.7 | — |
| 6 | 18-22 | H | H | $CH_3$ | $CH_3$ | 3 | 1 | 1 | 1 | — | — | — |

EXAMPLE 7 to 20

Preparation of Novel Hydroxybetaines

The procedures of Examples 1-6 were followed to produce the novel hydroxycarboxybetaines and hydroxysulfobetaines of the invention, however employing the corresponding alkylating agents. These products are shown in Table 2 below.

TABLE 2

| No. | $R_1$ | $R_2$ | $R_3$ | $R_4$ | $R_5$ | $R_6$ | $R_7$ | m | n | (Number of Groups) A | B | C | D | X | Anion | Cation |
|---|---|---|---|---|---|---|---|---|---|---|---|---|---|---|---|---|
| 7 | 10–12 | H | H | $CH_3$ | — | — | a) | 3 | 1 | 2 | 1 | — | — | $X_1$ | — | — |
| 8 | Σ (13–16) | | $CH_3$ | $-CH_2CH_2OH-$ | | — | $CH_3$ | 2 | 1 | 1 | 1 | — | — | $X_1$ | — | — |
| 9 | Σ (9–12) | | H | $CH_3$ | — | — | $CH_3$ | 3 | 3 | 1 | 1 | — | — | $X_2$ | — | — |
| 10 | Σ (9–12) | | — | $CH_3$ | — | — | $CH_3$ | 3 | 3 | — | 2 | — | — | $X_2$ | — | — |
| 11 | Σ (13–16) | | H | $CH_3$ | — | — | $CH_3$ | 3 | 3 | 1 | 1 | — | — | $X_2$ | — | — |
| 12 | Σ (13–16) | | — | $CH_3$ | — | — | $CH_3$ | 3 | 3 | — | 2 | — | — | $X_2$ | — | — |
| 13 | 14–16 | H | H | $CH_3$ | — | — | $CH_3$ | 3 | 3 | 1 | 1 | — | — | $X_2$ | — | — |

a) = $R_1-CH(OH)-\underset{\underset{R_2}{|}}{CH}-$ $X_1 = -(CH_2)_n-COO^{\ominus}$
$X_2 = -(CH_2)_n-SO_3^{\ominus}$
$X_3 = -CH_2-CH(OH)-CH_2-SO_3^{\ominus}$

| No. | $R_1$ | $R_2$ | $R_3$ | $R_4$ | $R_5$ | $R_6$ | $R_7$ | m | n | A | B | C | D | X | Anion | Cation |
|---|---|---|---|---|---|---|---|---|---|---|---|---|---|---|---|---|
| 14 | Σ (9–12) | | H | $CH_3$ | — | — | $CH_3$ | 3 | — | 1 | 1 | — | — | $X_3$ | — | — |
| 15 | 12–14 | H | $CH_3$ | $CH_3$ | — | — | $CH_3$ | 3 | — | 1 | 1 | — | — | $X_3$ | — | — |
| 16 | Σ(13–16) | | — | $CH_3$ | — | — | $CH_3$ | 3 | — | — | 1 | — | 1 | $X_3$ | — | $Na^{\oplus}$ |
| 17 | Σ(13–16) | | — | $CH_3$ | $CH_3$ | $CH_3$ | $CH_3$ | 3 | 1 | — | 1 | 1 | — | $X_1$ | $CH_3OSO_3^{\ominus}$ | — |
| 18 | Σ(9–12) | | — | $CH_3$ | $CH_3$ | $CH_3$ | b) | 3 | 1 | — | 1 | 2 | — | $X_1$ | $Cl^{\ominus}$ | — |
| 19 | 12–14 | H | — | $CH_3$ | $C_2H_5$ | $C_2H_5$ | $CH_3$ | 2 | — | — | 1 | 1 | — | $X_3$ | $C_2H_5OSO_3^{\ominus}$ | — |
| 20 | Σ(9–12) | | — | $CH_3$ | $CH_3$ | $CH_3$ | $CH_3$ | 3 | 3 | — | 1 | 1 | — | $X_2$ | $CH_3OSO_3^{\ominus}$ | — |

b) $R_1-CH(OH)-\underset{\underset{R_2}{|}}{CH}-$, $\Sigma(R_1+R_2)$ = 20 % $C_9$, 30 % $C_{10}$, 30 % $C_{11}$, 20 % $C_{12}$

FINISHING EXAMPLES 21 to 40

Polyamide charmeuse material is finished with a liquor ratio of 1 : 30 by the bath exhaust method with the use of an auxiliary agent comprising 0.5 or 1% of active substance (AS) relative to the weight of the commodity (CW).

The textile material is placed into the liquor in conventional apparatus at 40° C., treated for 15 minutes at 40° C., centrifuged, and dried for 3 minutes at 120° C.

After conditioning, the antistatic effect is measured by means of a static voltmeter under normal climatic conditions (65% relative humidity, 20° C.). The field decay half-value time (FHT) is measured, that is the time during which a charge, produced on the material by rubbing with steel, has dropped to half its value. The quantity of auxiliary agent is given in percent by weight relative to the weight of the commodity.

Table 1 shows the measured values found for the hydroxybetaines 1 to 20.

| No. | Quantity of auxiliary agent % AS relative to CW | FHT in seconds, measured at relative humidity of 65%/20° C |
|---|---|---|
| Without finishing | — | >60 |
| 1 | 1.0 | 0.5 |
| 2 | 0.5 | 0.5 |
| | 1.0 | 0.4 |
| 3 | 0.5 | 0.3 |
| | 1.0 | 0.3 |
| 4 | 0.5 | 0.4 |
| | 1.0 | 0.4 |
| 5 | 0.5 | 0.3 |
| | 1.0 | 0.3 |
| 6 | 0.5 | 0.3 |
| | 1.0 | <0.3 |
| 7 | 0.5 | 0.4 |
| | 1.0 | 0.3 |
| 8 | 0.5 | 0.4 |
| | 1.0 | 0.3 |
| 9 | 0.5 | 0.6 |
| | 1.0 | 0.3 |
| 10 | 0.5 | 0.7 |
| | 1.0 | 0.5 |
| 11 | — | — |
| | 1.0 | 0.0 |
| 12 | 0.5 | 0.3 |
| | 1.0 | 0.0 |
| 13 | 0.5 | 0.4 |
| | 1.0 | 0.3 |
| 14 | 0.5 | 2.0 |
| | 1.0 | 0.5 |
| 15 | 0.5 | 1.8 |
| | 1.0 | 0.5 |
| 16 | 0.5 | 1.3 |
| | 1.0 | 1.0 |
| 17 | 0.5 | <0.3 |
| | 1.0 | <0.3 |
| 18 | 0.5 | 0.3 |
| | 1.0 | 0.3 |
| 19 | 0.5 | 0.4 |
| | 1.0 | <0.3 |
| 20 | 0.5 | ≦0.3 |
| | 1.0 | <0.3 |

FINISHING EXAMPLE 41

Polyacrylonitrile high bulk yarn is finished with a liquor ratio of 1 : 50 by the bath exhaust method with auxiliary agent No. 5 (0.5% AS relative to the weight of the commodity).

For this purpose, the textile material is introduced into the liquor in conventional apparatus at 40° C., treated for 15 minutes at the same temperature, the yarn is centrifuged for 30 seconds and is dried at 60° C. The yarn has a full, smooth and soft feel. The electrical surface resistance, measured under normal climatic conditions, is $2.1 \times 10^8$ Ohms.

FINISHING EXAMPLE 42

Polyester material (diols loft) was finished with auxiliary agent No. 4 (1% AS relative to the weight of the commodity) by the bath exhaust method with a liquor ratio of 1 : 30. The finishing conditions corresponded to those given in Example 41. This material also had no tendency to charge electrostatically. The electrical surface resistance, measured under normal climatic conditions, was $5.8 \times 10^8$ Ohms.

The preceding specific embodiments are illustrative of the practice of the invention. It is to be understood, however, that other expedients known to those skilled in the art, or disclosed herein, may be employed without departing from the spirit of the invention or the scope of the appended claims.

We claim:

1. Hydroxysulfobetaines having the formula

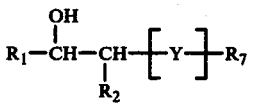

wherein Y represents two to five substituted nitrogens connected by $-(CH_2)_m-$ groups, selected from the group consisting of

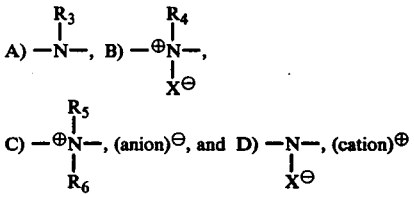

with the proviso that at least one of Y is B); $R_1$ is an alkyl and $R_2$ is a member selected from the group consisting of hydrogen and alkyl, where the sum of the carbon atoms in $R_1 + R_2$ is from 9 to 22; $R_3$ is a member selected from the group consisting of hydrogen, hydroxyethyl and alkyl having from 1 to 5 carbon atoms; $R_4$, $R_5$ and $R_6$ are individually members selected from the group consisting of hydroxyethyl and alkyl having from 1 to 5 carbon atoms; $R_7$ is a member selected from the group consisting of

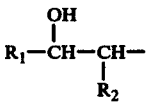

and $R_4$; $X^{\ominus}$ is a member selected from the group consisting of $-(CH_2)_n-SO_3^{\ominus}$ and $-CH_2-CH(OH)-CH_2-SO_3^{\ominus}$; m is an integer from 2 to 6; n is an integer from 1 to 4; $(anion)^{\ominus}$ represents a monovalent anionic group; and $(cation)^{\oplus}$ represents a monovalent cationic group.

2. The hydroxysulfobetaine of claim 1, being

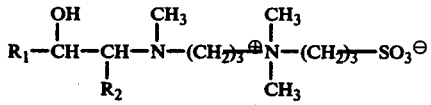

wherein $R_1$ and $R_2$ are alkyl and the sum of the carbon atoms in $R_1$ and $R_2$ is 9 to 12.

3. The hydroxysulfobetaine of claim 1, being

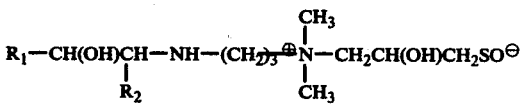

wherein $R_1$ is alkyl having 12 to 14 carbon atoms and $R_2$ is hydrogen.

4. The hydroxysulfobetaine of claim 1, being

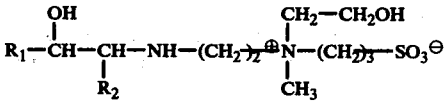

wherein $R_1$ and $R_2$ are alkyl and the sum of the carbon atoms in $R_1$ and $R_2$ is 9 to 12.

5. The hydroxysulfobetaine of claim 1, being

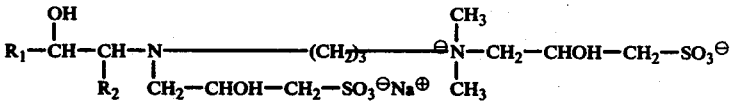

wherein $R_1$ and $R_2$ are alkyl and the sum of the carbon atoms in $R_1$ and $R_2$ is 13 to 16.

* * * * *